US007633241B2

(12) United States Patent
Lu et al.

(10) Patent No.: US 7,633,241 B2
(45) Date of Patent: Dec. 15, 2009

(54) BACKLIGHT MODULATION CIRCUIT

(75) Inventors: Jian-Hui Lu, Shenzhen (CN); Tong Zhou, Shenzhen (CN); He-Kang Zhou, Shenzhen (CN)

(73) Assignees: Innocom Technology (ShenZhen) Co., Ltd., Shenzhen, Guangdong Province (CN); Innolux Display Corp., Miao-Li County (TW)

( * ) Notice: Subject to any disclaimer, the term of this patent is extended or adjusted under 35 U.S.C. 154(b) by 29 days.

(21) Appl. No.: 11/825,886

(22) Filed: Jul. 9, 2007

(65) Prior Publication Data

US 2008/0007186 A1 Jan. 10, 2008

(30) Foreign Application Priority Data

Jul. 7, 2006 (TW) ..... 95124888 A

(51) Int. Cl.
*H05B 37/02* (2006.01)

(52) U.S. Cl. ..... 315/291; 315/307

(58) Field of Classification Search ..... 315/291, 315/307, 308, 209 R, 225, 244, 302, 361, 315/362; 361/93.1, 87
See application file for complete search history.

(56) References Cited

U.S. PATENT DOCUMENTS

| | | | | | |
|---|---|---|---|---|---|
| 3,781,470 | A * | 12/1973 | Horn | ..... | 348/540 |
| 5,272,327 | A * | 12/1993 | Mitchell et al. | ..... | 250/205 |
| 6,114,814 | A * | 9/2000 | Shannon et al. | ..... | 315/219 |
| 6,246,220 | B1 * | 6/2001 | Isham et al. | ..... | 323/224 |
| 6,885,532 | B2 | 4/2005 | Noro | | |

* cited by examiner

*Primary Examiner*—Douglas W Owens
*Assistant Examiner*—Jimmy T Vu
(74) *Attorney, Agent, or Firm*—Wei Te Chung

(57) ABSTRACT

An exemplary backlight modulation circuit (200) includes a pulse generator circuit (210) configured for generating a first square pulse; a voltage division circuit (230) configured for receiving the first square pulse and generating a second square pulse according to the first square pulse; an oscillator circuit (240) configured for generating a reference voltage; and an amplifier (200) comprising a negative input configured for receiving the second square pulse from the voltage division circuit, and a positive input configured for receiving the reference voltage from the oscillator circuit as a reference pulse signal, the amplifier being configured for generating a backlight adjusting signal according to the reference pulse signal and the second square pulse.

7 Claims, 4 Drawing Sheets

BACKLIGHT MODULATION CIRCUIT

FIELD OF THE INVENTION

The present invention relates to backlight modulation circuits that are typically used in liquid crystal displays (LCDs).

GENERAL BACKGROUND

An LCD has the advantages of portability, low power consumption, and low radiation. LCDs have been widely used in various portable information products such as notebooks, personal digital assistants (PDAs), video cameras and the like. Furthermore, the LCD is considered by many to have the potential to completely replace CRT (cathode ray tube) monitors and televisions.

A typical LCD includes an LCD panel, a backlight for illuminating the LCD panel, and a backlight control circuit for controlling the backlight. The backlight control circuit includes a pulse generator configured for generating a square pulse, a backlight modulation circuit configured for generating a backlight adjusting signal according to the square pulse, and an inverter circuit configured for transforming a low direct current (DC) voltage to a high alternating current (AC) voltage. The high AC voltage drives the backlight according to relative duty ratios of the backlight adjusting signal. The backlight can include one or more lamps, such as cold cathode fluorescent lamps.

FIG. 5 is a diagram of a typical backlight modulation circuit used in a backlight control circuit of an LCD. The backlight modulation circuit 100 includes a pulse generator 110, an integrating circuit 120, a voltage division circuit 130, an oscillator circuit 140, an amplifier 150, and a regulation circuit 160.

The amplifier 150 includes a negative input, a positive input, and an output.

The oscillator circuit 140 includes a low frequency oscillator 143 and a capacitor 141. The low frequency oscillator 143 is connected to ground via the capacitor 141. An electrical connecting node between the low frequency oscillator 143 and the capacitor 141 is connected to the positive input of the amplifier 150. A capacitance of the capacitor 141 is approximately 4.7 nF (nanofarads).

The pulse generator 110 includes a scaler 111, an NMOSFET (n-channel metal-oxide-semiconductor field-effect transistor) 112, a bias resistor 113, and a 5V (volts) DC power supply 114. The NMOSFET 112 includes a source electrode "S" connected to ground, a drain electrode "D" connected to the power supply 114 via the bias resistor 113, and a gate electrode "G" connected to an output of the scaler 111 for receiving a pulse signal therefrom.

The integrating circuit 120 includes an integrating resistor 121 and an integrating capacitor 122. The drain electrode "D" of the NMOSFET 112 is connected to ground via the integrating resistor 121 and the integrating capacitor 122 in series. A resistance of the integrating resistor 121 is approximately 47Ω (ohms). A capacitance of the integrating capacitor 122 is approximately 0.1 μF (microfarads).

The voltage division circuit 130 includes two voltage division resistors 131, 132. An electrical connecting node between the integrating resistor 121 and the integrating capacitor 122 is connected to ground via the voltage division resistor 131 and the voltage division resistor 132 in series. An electrical connecting node between the two voltage division resistors 131, 132 is connected to the negative input of the amplifier 150. A resistance of the voltage division resistor 131 is approximately 100 KΩ (kiloohms). A resistance of the voltage division resistor 132 is approximately 47 KΩ.

The regulation circuit 160 includes a current limiting resistor 161, a filter capacitor 162, and a 5V DC reference power supply 163. The reference power supply 163 is connected to ground via the current limiting resistor 161 and the filter capacitor 162 in series. An electrical connecting node between the current limiting resistor 161 and the filter capacitor 162 is connected to the negative input of the amplifier 150.

The pulse generator 110 outputs a square pulse at the drain electrode "D" of the NMOSFET 112. This square pulse is shown in FIG. 6. An amplitude of the square pulse is approximately 5V. Then the integrating circuit 120, the voltage division circuit 130, and the regulation circuit 160 transform the square pulse signal to a 1.5V DC voltage. This 1.5V DC voltage is shown in FIG. 7. Then the regulation circuit 160 provides the 1.5V DC voltage to the negative input of the amplifier 150. The oscillator circuit 140 is configured to generate a triangular pulse (as shown in FIG. 8), and provide the triangular pulse to the positive input of the amplifier 150. An amplitude of the triangular pulse is approximately 1.5V. The amplifier 150 is configured to output a backlight adjusting signal to an inverter circuit (not shown).

Because the backlight modulation circuit 100 includes the integrating circuit 120, the voltage division circuit 130, and the regulation circuit 160, the backlight modulation circuit 100 is somewhat complicated. Furthermore, the 5V square pulse outputted from the pulse generator circuit 110 is transmitted to the positive input of the amplifier 150 via the integrating circuit 120, the voltage division circuit 130, and the regulation circuit 160 in series. Thus interference may occur when the 5V square pulse is transmitted to the amplifier 150.

It is desired to provide a new backlight modulation circuit which can overcome the above-described deficiencies.

SUMMARY

In one preferred embodiment, a backlight modulation circuit includes a pulse generator circuit configured for generating a first square pulse; a voltage division circuit configured for receiving the first square pulse and generating a second square pulse according to the first square pulse; an oscillator circuit configured for generating a reference voltage; and an amplifier comprising a negative input configured for receiving the second square pulse from the voltage division circuit, and a positive input configured for receiving the reference voltage from the oscillator circuit as a reference pulse signal, the amplifier being configured for generating a backlight adjusting signal according to the reference pulse signal and the second square pulse.

Other novel features and advantages of the backlight modulation circuit will become more apparent from the following detailed description when taken in conjunction with the accompanying drawings.

DETAILED DESCRIPTION OF PREFERRED EMBODIMENTS

Reference will now be made to the drawings to describe various embodiments of the present invention in detail.

Figure 1:
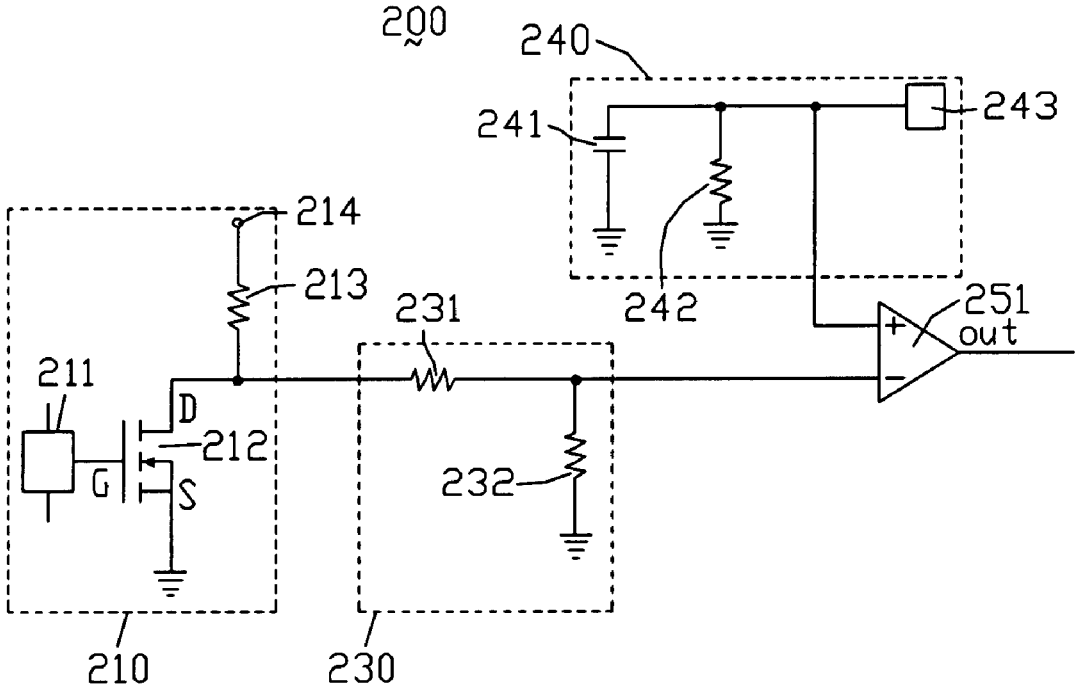
FIG. 1 is a diagram of a backlight modulation circuit according to an exemplary embodiment of the present invention, the backlight modulation circuit including a pulse generator, a voltage division circuit, and an oscillator circuit.

FIG. 1 is a diagram of a backlight modulation circuit according to an exemplary embodiment of the present invention, the backlight modulation circuit being typically used in an LCD. The LCD typically also includes an LCD panel and a backlight. The backlight can include one or more lamps, such as cold cathode fluorescent lamps. The backlight is driven by an inverter according to a backlight adjusting signal generated by the backlight modulation circuit, and the lamps thereby illuminate the LCD panel. The backlight modulation circuit 200 includes a pulse generator 210, a voltage division circuit 230, an oscillator circuit 240, and an amplifier 251.

The amplifier 251 includes a negative input, a positive input, and an output.

The oscillator circuit 240 includes a low frequency oscillator 243, a capacitor 241, and a resistor 242. The capacitor 241 and the resistor 242 are connected in parallel between the low frequency oscillator 243 and ground. An electrical connecting node between the low frequency oscillator 243 and the resistor 242 is connected to the positive input of the amplifier 150. A capacitance of the capacitor 241 is approximately 4.7 nF. A resistance of the resistor 242 is approximately 604 KΩ.

The pulse generator 210 includes a scaler 211, an NMOSFET 212, a bias resistor 213, and a 5V DC power supply 214. The NMOSFET 212 includes a source electrode "S" connected to ground, a drain electrode "D" connected to the power supply 214 via the bias resistor 213, and a gate electrode "G" connected to an output of the scaler 111 for receiving a pulse signal therefrom.

The voltage division circuit 230 includes two voltage division resistors 231, 232. The drain electrode "D" of the NMOSFET 212 is connected to ground via the voltage division resistor 231 and the voltage division resistor 232 in series. An electrical connecting node between the two voltage division resistors 231, 232 is connected to the negative input of the amplifier 251. A resistance of the voltage division resistor 231 is approximately 22 KΩ. A resistance of the voltage division resistor 232 is approximately 10 KΩ.

Figure 2:
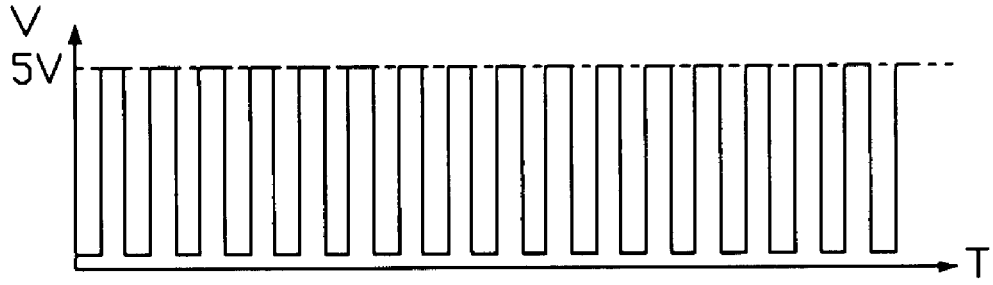
FIG. 2 is a graph of voltage versus time, showing a square pulse provided from the pulse generator of the backlight modulation circuit of FIG. 1.
Figure 3:
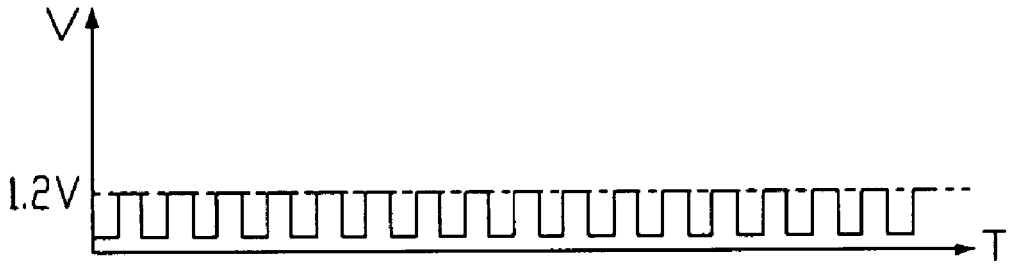
FIG. 3 is a corresponding graph of voltage versus time, showing the square pulse as provided from the voltage division circuit of the backlight modulation circuit of FIG. 1.

The pulse generator 210 outputs a first square pulse at the drain electrode "D" of the NMOSFET 212. This first square pulse is shown in FIG. 2. An amplitude of the first square pulse is approximately 5V. Then the voltage division circuit 230 reduces the amplitude of the first square pulse to 1.2V, thereby forming a second square pulse. This second square pulse is shown in FIG. 3. The voltage division circuit 230 then provides the second square pulse to the negative input of the amplifier circuit 251.

Figure 4:
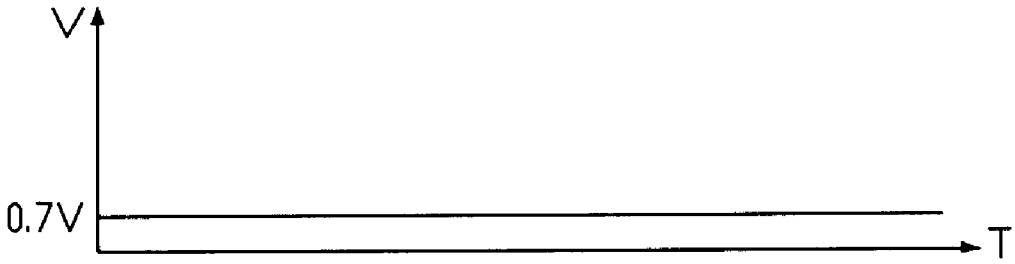
FIG. 4 is a corresponding graph of voltage versus time, showing a 1.2V DC voltage provided from the oscillator circuit of the backlight modulation circuit of FIG. 1.
Figure 5:
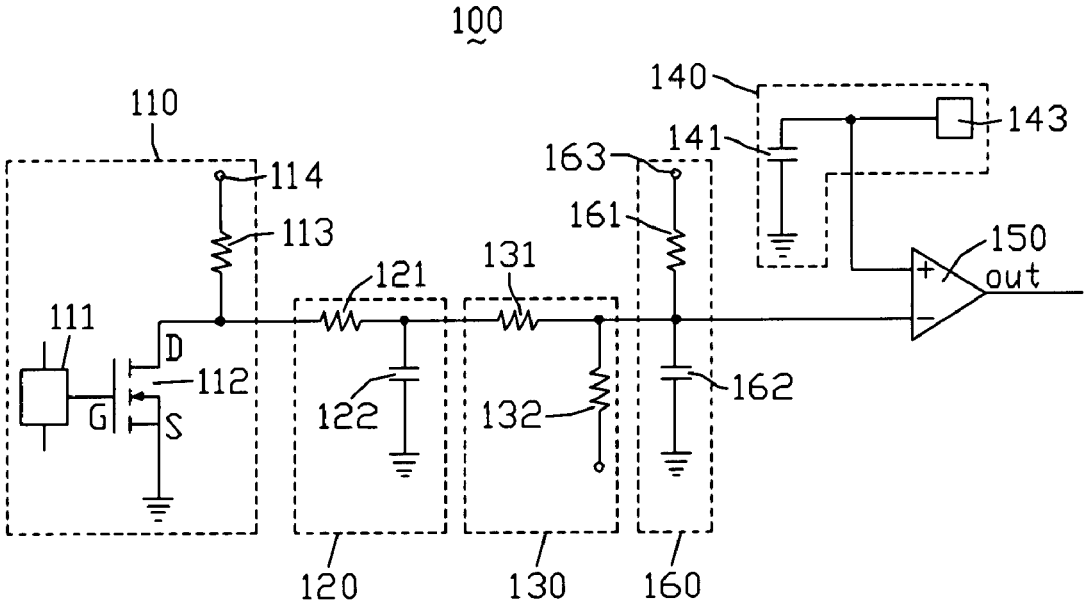
FIG. 5 (RELATED ART)
FIG. 5 is a diagram of a conventional backlight modulation circuit used in a backlight control circuit of an LCD, the backlight modulation circuit including a pulse generator, a voltage division circuit, and a oscillator circuit.
Figure 6:
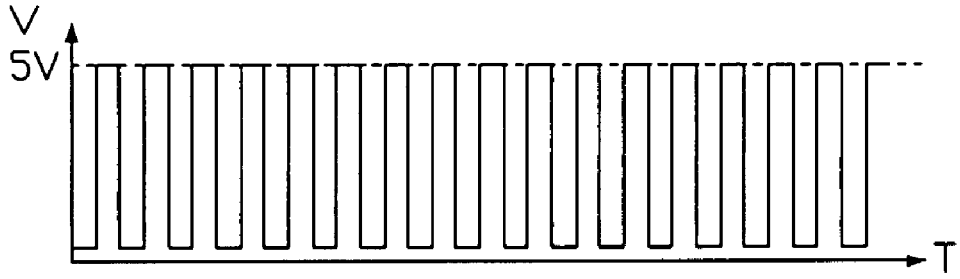
FIG. 6 (RELATED ART)
FIG. 6 is a graph of voltage versus time, showing a square pulse provided from the pulse generator of the backlight modulation circuit of FIG. 5.
Figure 7:
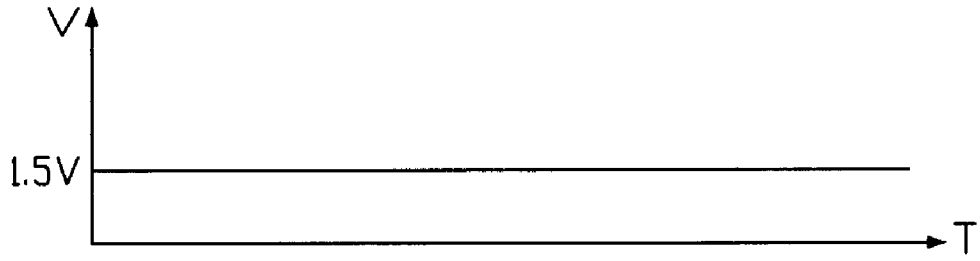
FIG. 7 (RELATED ART)
FIG. 7 is a corresponding graph of voltage versus time, showing a corresponding 1.5V DC voltage provided from the voltage division circuit of the backlight modulation circuit of FIG. 5.
Figure 8:
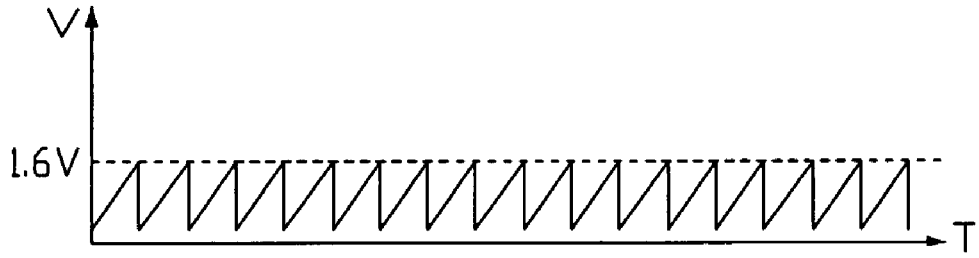
FIG. 8 (RELATED ART)
FIG. 8 is a corresponding graph of voltage versus time, showing a triangular pulse provided from the oscillator circuit of the backlight modulation circuit of FIG. 5.

The oscillator circuit 240 generates a 0.7V DC voltage (as shown in FIG. 4), and provides the 0.7V DC voltage to the positive input of the amplifier 251 as a reference pulse signal. The amplifier 251 outputs a backlight adjusting signal according to the signals received by the positive input and the negative input, and provides the backlight adjusting signal to an inverter circuit (not shown) for adjusting a brightness of the backlight.

Because the backlight modulation circuit 200 does not include an integrating circuit or a regulation circuit, the backlight modulation circuit 200 is relatively simple. Furthermore, the 5V square pulse outputted from the pulse generator circuit 210 is provided to the positive input of the amplifier 251 only via the voltage division circuit 230. Thus any interference generated when the 5V square pulse is transmitted to the amplifier 251 is reduced.

It is to be understood, however, that even though numerous characteristics and advantages of the preferred embodiments have been set out in the foregoing description, together with details of the structures and functions of the embodiments, the disclosure is illustrative only; and that changes may be made in detail, especially in matters of arrangement of parts within the principles of present invention to the full extent indicated by the broad general meaning of the terms in which the appended claims are expressed.

What is claimed is:

1. A backlight modulation circuit comprising:

a pulse generator circuit configured for generating a first square pulse;

a voltage division circuit configured for receiving the first square pulse and generating a second square pulse according to the first square pulse;

an oscillator circuit configured for generating a reference direct current (DC) voltage; and an amplifier comprising a negative input configured for receiving the second square pulse from the voltage division circuit, and a positive input configured for receiving the reference DC voltage from the oscillator circuit as a reference pulse signal, the amplifier being configured for generating a backlight adjusting signal according to the reference pulse signal and the second square pulse, wherein the oscillator circuit comprises a low frequency oscillator, a capacitor, and a resistor, the capacitor and the resistor are connected in parallel between the low frequency oscillator and ground, and an electrical connecting node between the low frequency oscillator and the resistor is connected to the positive input of the amplifier.

2. The backlight modulation circuit as claimed in claim 1, wherein a capacitance of the capacitor is approximately 4.7 nF.

3. The backlight modulation circuit as claimed in claim 1, wherein a resistance of the resistor is approximately 604 KΩ.

4. A backlight modulation circuit comprising:

a pulse generator circuit configured for generating a square pulse;

a voltage division circuit configured for reducing an amplitude of the square pulse;

an oscillator circuit configured for generating a reference direct current (DC) voltage; and an amplifier comprising a negative input configured for receiving the reduced amplitude square pulse from the voltage division circuit, and a positive input configured for receiving the reference DC voltage from the oscillator circuit as a reference pulse signal, the amplifier being configured for generating a backlight adjusting signal according to the reference pulse signal and the reduced amplitude square pulse, wherein the oscillator circuit comprises a low frequency oscillator, a capacitor, and a resistor, the capacitor and the resistor are connected in parallel between the low frequency oscillator and ground, and an electrical connecting node between the low frequency oscillator and the resistor is connected to the positive input of the amplifier.

5. The backlight modulation circuit as claimed in claim 4, wherein a capacitance of the capacitor is approximately 4.7 nF.

6. The backlight modulation circuit as claimed in claim 4, wherein a resistance of the resistor is approximately 604 KΩ.

7. A backlight modulation circuit comprising:

a pulse generator circuit configured for generating a square pulse;

a voltage division circuit configured for reducing an amplitude of the square pulse;

an oscillator circuit configured for generating a reference direct current (DC) voltage; and an amplifier comprising a negative input configured for receiving the reduced amplitude square pulse from the voltage division circuit and a positive input configured for receiving the reference DC voltage from the oscillator circuit as a reference pulse signal, the amplifier being configured for generating a backlight adjusting signal according to the reference pulse signal and the reduced amplitude square pulse, wherein the reference DC voltage is approximately 0.7V.

* * * * *